US005953432A

United States Patent [19]

Yanagawa et al.

[11] Patent Number: 5,953,432

[45] Date of Patent: *Sep. 14, 1999

[54] LINE SOURCE SPEAKER SYSTEM

[75] Inventors: Hirofumi Yanagawa; Ziqing Zhang, both of Tokyo, Japan

[73] Assignee: Pioneer Electronic Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,183

[22] Filed: Aug. 14, 1997

Related U.S. Application Data

[63] Continuation of application No. 08/674,988, Jul. 3, 1996, abandoned, which is a continuation of application No. 08/174,317, Dec. 30, 1993, abandoned.

[30] Foreign Application Priority Data

Jan. 7, 1993 [JP] Japan ..... 5-001321

[51] Int. Cl.[6] ..... H04R 1/02

[52] U.S. Cl. ..... 381/335; 381/89; 381/336

[58] Field of Search ..... 381/90, 89, 92, 381/335, 336

[56] References Cited

U.S. PATENT DOCUMENTS 5,052,685 10/1991 Lowe et al. ..... 381/17
5,233,664 8/1993 Yanagawa et al. ..... 381/89

FOREIGN PATENT DOCUMENTS 0217300 12/1986 Japan ..... 381/90

*Primary Examiner*—Jerome Grant, II
*Attorney, Agent, or Firm*—Nikaido, Marmelstein, Murray & Oram LLP

[57] ABSTRACT

A plurality of speakers are arranged in line, and a plurality of digital filters are provided for the speakers. Each of the digital filters is applied with a plurality of audio signals. Characteristics of each digital filter is adjusted so as to provide patterns of directivity to each speaker dependent on the input audio signals.

1 Claim, 6 Drawing Sheets

LINE SOURCE SPEAKER SYSTEM

This application is a continuation of application Ser. No. 08/674,988 filed Jul. 3, 1996, which is a continuation of application Ser. No. 08/174,317 filed Dec. 30, 1993, both now abandoned.

FIELD OF THE INVENTION

The present invention relates to a line source speaker system, and more particularly to a system for controlling the directivity thereof.

BACKGROUND OF THE INVENTION

One of the characteristics which determine the quality of a loudspeaker is the directivity. The directivity defines variations of the sound pressure in different propagating directions of the sound. However, a wider directivity does not automatically ensure the quality of the speaker. It is rather advisable to determine the directivity pattern depending on the purpose of the speaker and the size of the area where the loudspeaker is expected to carry sound. For example, for an audio system, a wide directivity is required. For a public-address system, in order to prevent howling, a narrow directivity wherein the sound is propagated only in certain directions is required.

There are other factors to be considered when determining the directivity of the loudspeaker. In a speaker system employing a single speaker unit, the directivity is determined depending on the construction of the unit, that is, whether the speaker unit is a cone speaker or a horn speaker, and in the case of the cone speaker, the depth of the conical diaphragm. In a line source speaker system, where a plurality of speaker units are disposed in a linear array, each speaker unit is adapted to emit sound only in a direction determined in accordance with the physical construction and disposition of the speaker units.

Japanese Patent Application Laid-Open Nos. 2-239798 and 5-41897 disclose systems where digital filters are provided to electrically control a directivity pattern.

Referring to FIG. 6, such a speaker system comprises a digital filter array 10, amplifier array 12, and a speaker unit array 14. The digital filter array 10 comprises digital filters 16-1 to 16-n each of which is a finite impulse response (FIR) filter. Each digital filter is applied with the same input signal through a common input terminal IN. The amplifier array 12 comprises amplifiers 18-1 to 18-n, each of which is connected with the corresponding filters 16-1 to 16-n, and further to corresponding speaker units 20-1 to 20-n of the speaker unit array 14. The filter coefficients of each digital filter is set such that each speaker unit has a directivity adapted to provide an optimum directivity as a whole system.

SUMMARY OF THE INVENTION

An object of the present invention is to provide a speaker system which emits sounds at a desired directivity.

According to the present invention there is provided a line source speaker system having a plurality of speakers arranged in line, comprising a plurality of digital filters each of which is electrically connected to a corresponding speaker in the speakers, each of the digital filters being applied with a plurality of audio signals, means for adjusting characteristics of each digital filter so as to provide patterns of directivity to each speaker dependent on the input audio signals.

In an embodiment of the present invention, each of the digital filters is applied with an audio signal. The audio signal is divided into a plurality of audio signals which are controlled to provide patterns of directivity.

In an aspect of the invention, the means is provided for adjusting characteristics of digital filters other than both end filters for both end speakers.

Other objects and features of this invention will become understood from the following description with reference to the accompanying drawings.

DETAILED DESCRIPTION OF THE PREFERRED EMBODIMENTS

Figure 1A:
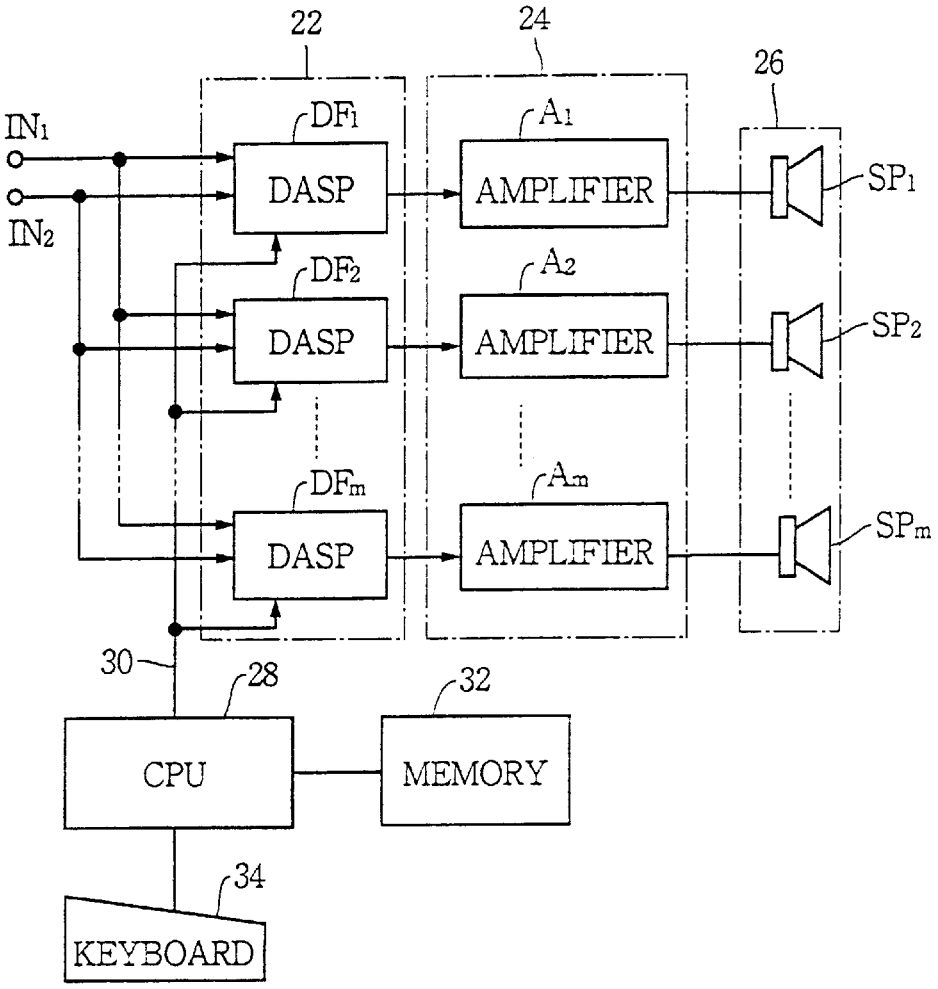
FIG. 1*a* is a block diagram of a speaker system according to the present invention.

Referring to FIG. 1*a*, a line source stereo system of the present invention has a digital filter array 22, amplifier array 24 and a speaker unit array 26. The digital filter array 22 has a plurality of digital audio signal processors (DASP) $DF_1$ to $DF_m$, each having the same construction as regards to the tap and multiplication coefficient thereof. Each DASP is applied with first and second audio signals $S_1$ and $S_2$ through a first signal input terminal IN1 and a second signal input terminal IN2, respectively.

Each of the DASPs $DF_1$ to $DF_m$ comprises a conventional linear FIR filter as a digital signal processor. The FIR filter has an arithmetic and logic unit for executing arithmetic and logic calculation, a sequencer including a program counter, command register and decoder for sequentially controlling the calculations, ROM for storing a required program, RAM for storing data, register for temporarily storing the data, and an input/output port for transmitting and receiving data. These components are connected to one another through a bus.

The DASPs $DF_1$ to $DF_m$ are connected to a CPU 28 through a line 30. The CPU 28 is connected to a memory 32 wherein filter coefficient data $\alpha hi$ for each DASP are stored. A keyboard 34 is operated to set the filter coefficients of the DASPs in accordance with the stored data.

Figure 1B:
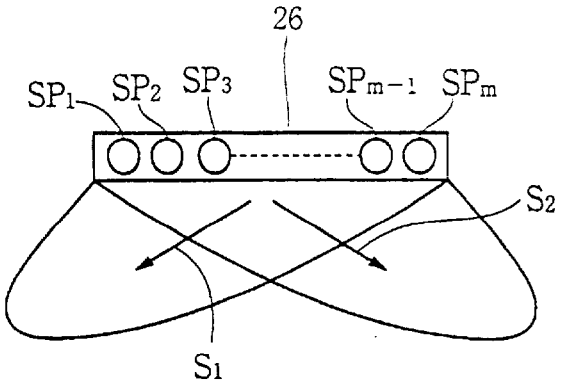
FIG. 1*b* is a schematic plan view of a speaker unit array explaining the operation of the speaker system.

The speaker unit array 26 comprises a plurality of speaker units $SP_1$ to $SP_m$, each equidistantly disposed in a horizontal linear array as shown in FIG. 1*b*. The speaker units $SP_1$ to $SP_m$ preferably have the same physical properties. That is, such factors as the diameters of the cone, lowest resonance frequency and the diaphragm mass, which determine the characteristics of the speaker units are all the same. The frequency range of the speaker units may be selected as appropriate dependent on the purpose of the speaker system. Namely, the speaker units may be a woofer, a mid-range speaker, a tweeter, or a full-range speaker. The speaker units may each be housed in an enclosure or be mounted on a single baffle board or on a wall.

Each of the DASPs $DF_1$ to $DF_m$ is serially connected to the corresponding speaker units $SP_1$ to $SP_m$ through amplifiers $A_1$ to $A_m$ of the amplifier array 24.

In operation, each of the DASPs $DF_1$ to $DF_m$ is applied with the first and second audio signals $S_1$ and $S_2$ which are parallely processed therein so as to provide a desired directivity for each audio signal by each of the speaker units $SP_1$ and $SP_m$ in accordance with the filter coefficients αhi of the DASPs. Namely, as shown in FIG. 1*b*, sound wave beams representing the first and second audio signals $S_1$ and $S_2$ are propagated in the opposite directions in forms of beams as shown by the arrows indicated as $S_1$ and $S_2$, respectively.

Figure 2:
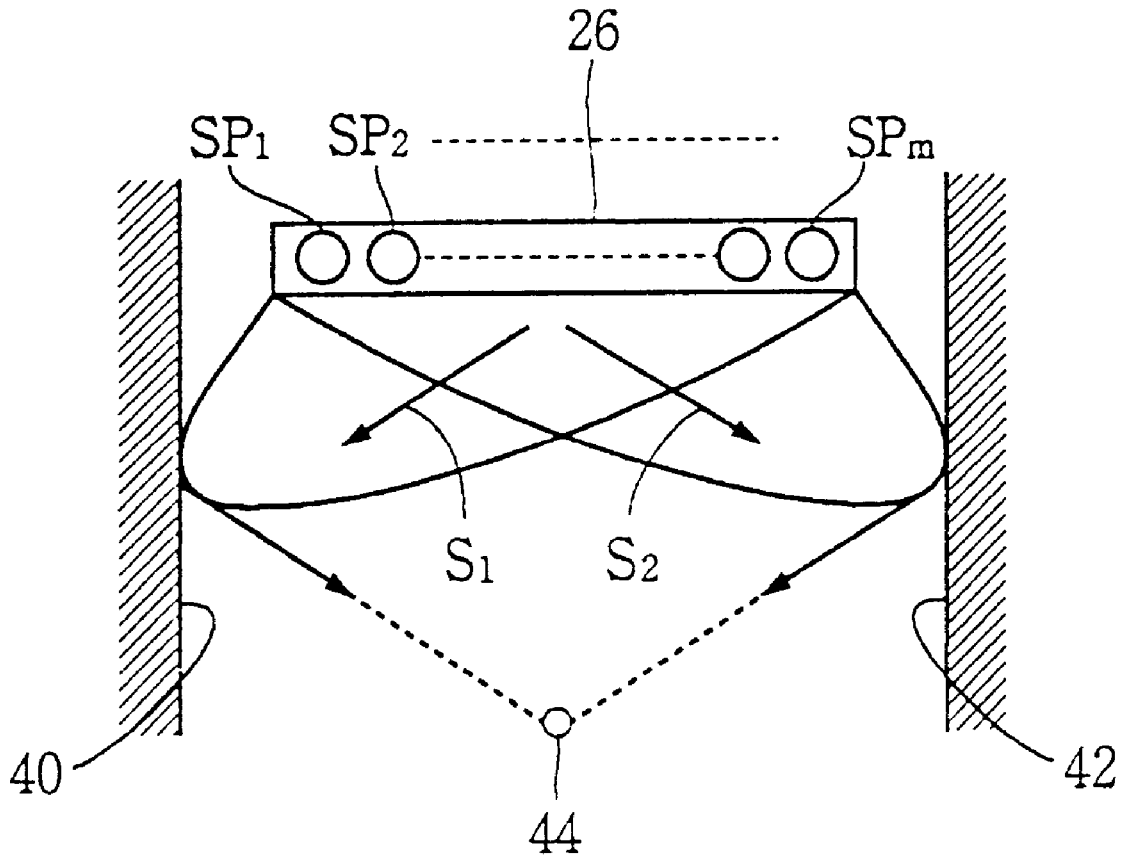
FIG. 2 is a schematic plan view of the speaker unit array explaining the operation of the speaker system of a second embodiment of the present invention.

Referring to FIG. 2, in a speaker system of the second embodiment of the present invention, the speaker unit array 26 is disposed between opposite walls 40 and 42. Other constructions are the same as those shown in FIG. 1*a*. The sound waves resulting from the first audio signals $S_1$ is reflected on the wall 40 and the sound wave of the second audio signals $S_2$ is reflected on the wall 42. The reflected sound waves are directed toward a listener at a listening point 44. As a result, a surround system where the sound laterally propagates is obtained.

The second embodiment may be modified to provide a front reflector and a rear reflector instead of the side walls.

Figure 3A:
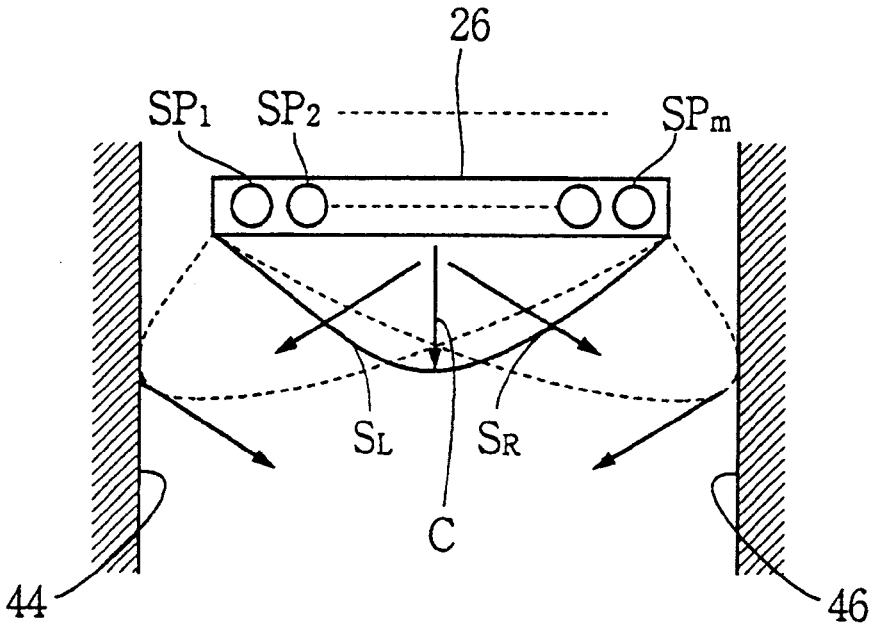
FIG. 3*a* is a schematic plan view of the speaker unit array explaining the operation of the speaker system of a third embodiment.

The speaker system of the third embodiment is the same as FIG. 1*a*. The DASPs $DF_1$ to $DF_m$ are applied with surround signals $S_R$ and $S_L$ and a center signal C as shown in FIG. 3*a*. The speaker unit array 26 is arranged between right and left walls 46 and 44 as in the second embodiment. The DASPs $DF_1$ to $DF_m$ process the surround signals $S_R$ and $S_L$, and the center signal C so that the speaker units $SP_1$ to $SP_m$ emit the corresponding sound waves as shown by the arrows indicated $S_R$, $S_L$, and C, respectively, in FIG. 3*a*. Namely, the sound wave representing the center signal C is emitted from the center of the speaker unit array 26 straight forwardly. On the other hand, the sound wave representing the surround signal $S_R$ is directed to reflect against the right wall 46 and the sound wave representing the surround signal $S_L$ is reflected against the left wall 44, so that both waves are focused at the center.

Figure 3B:
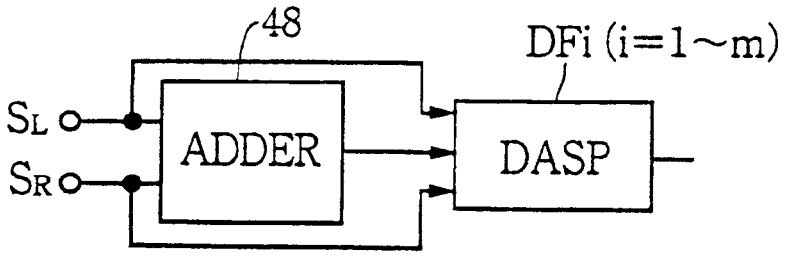
FIG. 3*b* is a block diagram showing an example of a part of the stereo system of the third embodiment.

As shown in FIG. 3*b*, the signals $S_R$ and $S_L$ may be added together by an adder 48 to produce the center signal C. The signals $S_R$ and $S_L$ and C are thus fed to each DASP.

Figure 4:
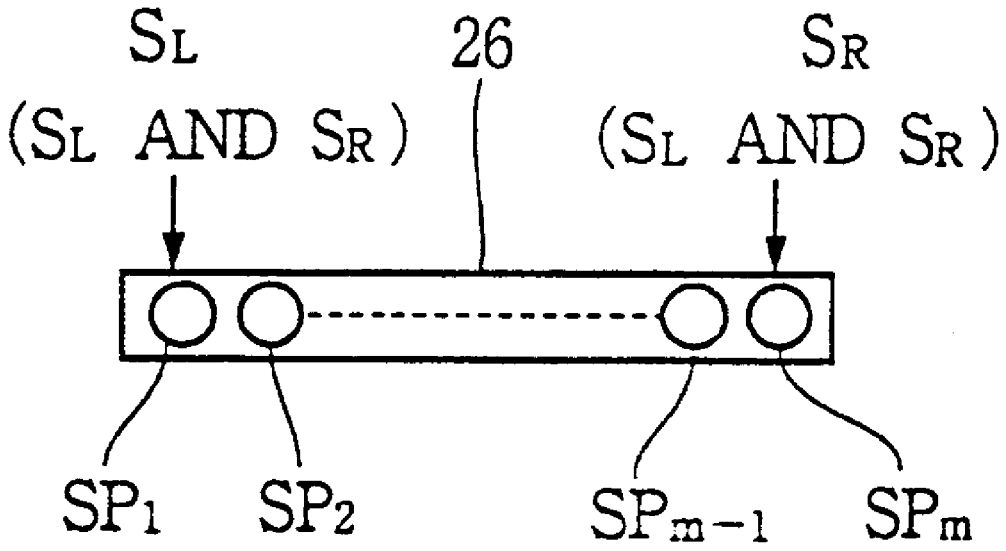
FIG. 4 is a schematic plan view of the speaker unit array explaining the operation of the speaker system of a fourth embodiment of the present invention.

As shown in FIG. 4, the speaker unit array 26 of the fourth embodiment of the present invention is so adapted that only the directivities of the speaker units in the middle are controlled. Namely, each of the right and left end speaker units $SP_m$ and $SP_1$ is fed with a corresponding audio signal $S_R$ or $S_L$, respectively, thereby emitting the sound wave in a straight forward direction. The other speaker units $SP_2$ and $SP_{m-1}$ are fed with directionally controlled audio signals $S_R$ and $S_L$ as described in the previous embodiments.

The present embodiment may be modified to apply signals $S_R$ and $S_L$ to the end speakers $SP_1$ and $SP_m$. Furthermore, one or two speakers positioned at the center of the array 26 may be applied with another signal, the directivity of which is not controlled, for example, the center signal.

Figure 5:
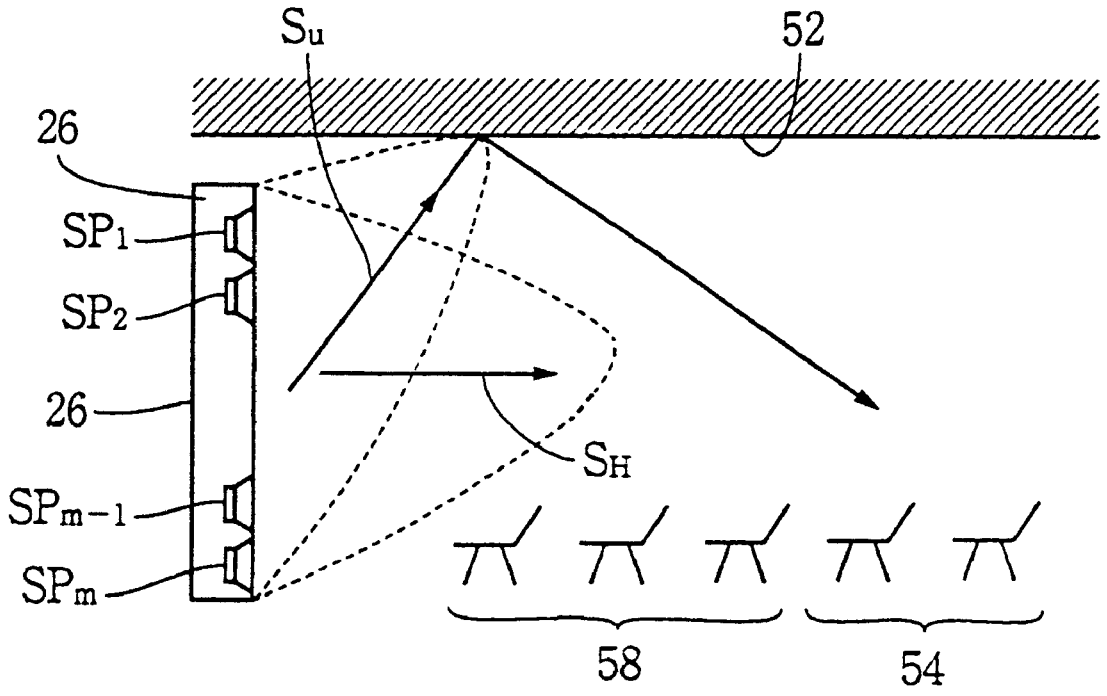
FIG. 5 is a schematic plan view of the speaker unit aray explaining the operation of the speaker system of a fifth embodiment.
Figure 6:
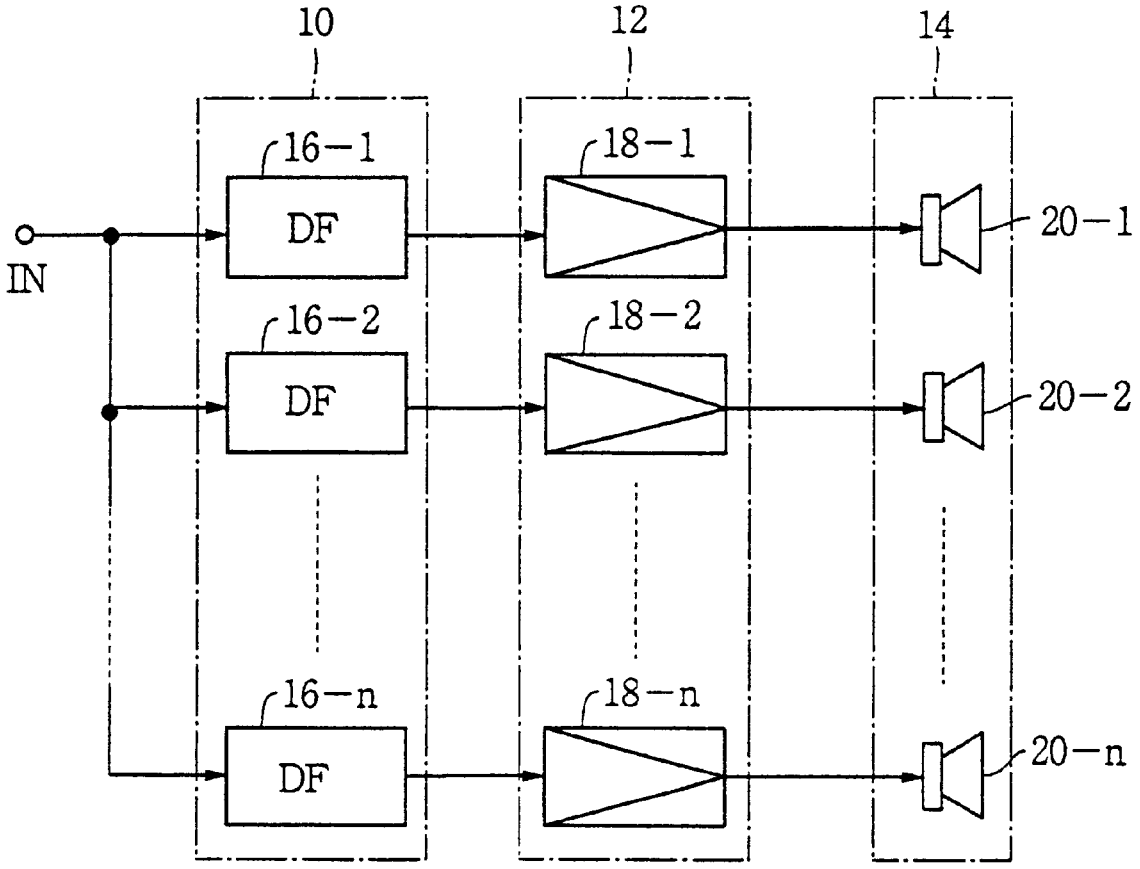
FIG.6 PRIOR ART
FIG. 6 is a block diagram showing a conventional line source speaker system.

Referring to FIG. 5, the speaker unit array 26 according to the speaker system of the fifth embodiment is disposed in an vertical arrangement so as to render the sound waves emitted therefrom to propagate in two directions, one of which is horizontal, and the other upward. Two audio signals for the two directions are obtained from only one audio signal. The first audio signal fed to the digital filter array 22 which is shown in FIG. 1*a* is an upward signal $S_U$ and the second audio signal is a horizontal signal $S_H$. The sound wave of the upward signal $S_U$ is reflected on a ceiling 52 and propagates toward rear seats 54. On the other hand, the horizontal signal $S_H$ is directly propagated toward front seats 58. The upward signal $S_U$ and the horizontal signal $S_H$ are identical to each other so that the audience in the rear seats 54 are able to hear the same sound as the audience in the front seats 58.

In the embodiments of the present invention, the filter coefficients of each DASP may be identical to one another, enabling the coefficients to be simultaneously fed to all of the DASPs. The transmission of the coefficient data is hence facilitated. Moreover, only one table is necessary in the memory 32.

Each DASP may comprise an infinite impulse response filter instead of the FIR filter. The filter coefficient may be calculated in accordance with a nonlinear optimal method as in the system disclosed in Japanese Patent Application Laid-Open 5-41897. The present invention may be further applied to a speaker system described in Japanese Patent Application Laid-Open 2-239798 which do not employ an optical method.

From the foregoing it will be understood that the present invention provides a speaker system wherein the directivity thereof can be controlled as desired.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A line source speaker system having a plurality of speakers arranged in a line, comprising:

a plurality of digital filters each of which is electrically connected to a corresponding speaker in said speaker system;

each of said digital filters receiving two surround signals through first and second input terminals and a center signal generated by adding the two surround signals;

control means for providing characteristics to each digital filter wherein two output surround sound waves, propagating in directions which are away from each other with respect to an axis which is perpendicular to a diaphragm of corresponding speakers, and a center sound wave are output by said speakers dependent on the two surround signals and the characteristic of each digital filter, the center sound wave being provided such that the sound wave is directed to an audience, and surround sound waves are reflected from opposite side walls to the audience.

* * * * *